US005734335A

United States Patent [19]

Brogi et al.

[11] Patent Number: 5,734,335

[45] Date of Patent: Mar. 31, 1998

[54] FOREST SURVEILLANCE AND MONITORING SYSTEM FOR THE EARLY DETECTION AND REPORTING OF FOREST FIRES

[75] Inventors: Giulio Brogi; Luca Pietranera; Francesco Frau, all of Rome, Italy

[73] Assignees: Finmeccanica S.p.A.; Ramo Aziendale Alenia, both of Rome, Italy

[21] Appl. No.: 753,778

[22] Filed: Dec. 2, 1996

Related U.S. Application Data

[63] Continuation-in-part of Ser. No. 581,759, Jan. 2, 1996, abandoned, and a continuation-in-part of Ser. No. 386,222, Feb. 9, 1995, abandoned, and a continuation-in-part of Ser. No. 752,504, filed as PCT/EP90/02244 Dec. 19, 1990, abandoned.

[30] Foreign Application Priority Data

Dec. 20, 1989 [IT] Italy ..... 48686 A/89

[51] Int. Cl.[6] ..... G08C 19/06

[52] U.S. Cl. ..... 340/870.05; 340/870.04; 340/870.16; 340/577; 340/825.37; 364/420

[58] Field of Search ..... 340/870.05, 870.06, 340/870.07, 870.09, 870.1, 870.16, 870.17, 577, 578, 584, 588, 601, 825.1, 825.15, 825.16, 825.17, 825.36, 825.37; 364/420; 348/143, 153, 159

[56] References Cited

U.S. PATENT DOCUMENTS

| | | | |
|---|---|---|---|
| 3,686,434 | 8/1972 | Lemelson | 348/153 |
| 3,852,730 | 12/1974 | Commins | 340/870.05 |
| 4,357,602 | 11/1982 | Lemelson | 340/577 |
| 5,124,915 | 6/1992 | Krenzel | 364/420 |

FOREIGN PATENT DOCUMENTS

| | | |
|---|---|---|
| 0148949 | 7/1985 | European Pat. Off. . |
| 0279792 | 8/1988 | European Pat. Off. . |
| 2415889 | 10/1974 | Germany . |
| 3147752 | 6/1982 | Germany . |
| 3307132 | 9/1983 | Germany . |
| 3710265 | 10/1988 | Germany . |

OTHER PUBLICATIONS

Gretsi, 11th Colloque sur le Traitement du Signal et des Images, Nice, Jun. 1–5, 1987, G. Jacovitti et al.: "A Real Time Image Processor for Automatic Bright Spot Detection," pp. 587–590.

Telecom Report, vol. 6, part 2, Apr. 1983, (Passau, Germany), T. Tussing: "Pulsmeldetechnik setzt neue Ma Bstäbe im Brandschutz," pp. 82–87.

*Primary Examiner*—Jeffery Hofsass
*Assistant Examiner*—Andrew Hill
*Attorney, Agent, or Firm*—Cohen, Pontani, Lieberman & Pavane

[57] ABSTRACT

A forest surveillance and monitoring system for the early detection and reporting of forest fires in a forest area under surveillance. The system comprises a number of remote detectors placed within the forest area and telemetrically linked to a central processing system. Each remote detector comprises an infrared sensor and video camera mounted on a remotely controllable moving platform. The remote detector also contains a weather sensor for collecting critical weather data at the remote site. Located at each remote site is a remote processor which controls all data collection, the remote processor being in communication with the central site via a remote communication subsystem and central communication system which are linked via radio. The central control site receives weather data and alarm information as well as video images from the remote detector site via the communication system. The central site contains video monitoring equipment for visual inspection of the area under surveillance as well as a central processor for overall system control. The central processor receives data from the multiple remote detectors and is capable of displaying alarms on digitized topographic maps of the forest under surveillance, as well as producing a forecast of the anticipated growth pattern of the fire front based upon the received data and information stored in a historical data base. Hard copy output of topographic maps showing the fire sites and fire growth path are available from the central processor for use by fire fighting personnel.

10 Claims, 3 Drawing Sheets

FOREST SURVEILLANCE AND MONITORING SYSTEM FOR THE EARLY DETECTION AND REPORTING OF FOREST FIRES

This is a Continuation-In-Part under 37 U.S.C. 1.53 of application Ser. No. 08/581,759 filed Jan. 2, 1996, now abandoned Ser. No. 08/386,222 Feb. 9, 1995, now abandoned, and Ser. No. 07/752,504, filed as PCT/EP90/02244 Dec. 19, 1990, now abandoned.

BACKGROUND OF THE INVENTION

1. Field of the Invention

This invention relates to a system for monitoring a forest or a portion of a forest for the early detection and reporting of forest fires. The system uses remotely deployed detection units which contain infrared sensors, video cameras, weather sensing equipment, a local processor, and communication equipment for communicating to a central command station. The central command station houses a central data processing unit which receives all information from the remote detection units, issues command signals for the control of the remote detection units, and is capable of displaying video images of the scene as detected by the remote detectors. The central data processing unit also contains a program which makes use of the data received from the remote detection units to produce a forecast of the expected growth pattern of the forest fire to assist fire fighting personnel during fire fighting.

2. Description of the Related Art

Presently, the problem of fires in wooded areas presents a grave concern. Recent forest fires in national parks throughout the world have highlighted the need for improved fire detection and control methods.

At the current time, most forests are not adequately equipped with early fire detection methodologies. Most fire detection is still trusted to lookout personnel in remotely placed towers or other means of human observation. The obvious drawbacks of leaving such large areas of territory trusted to merely human observation are those of late detection, false alarms, and the inability to rapidly deploy fire fighting personnel along the predicted fire front, thereby undermining the firefighters' effectiveness.

It would therefore be greatly advantageous to provide a system which can remotely monitor the forest and rapidly detect and report the presence of forest fires as well as forecast the expected growth pattern of the forest fire for optimal deployment of fire fighting personnel.

OBJECTS AND SUMMARY OF THE INVENTION

The present invention relates to an integrated system for the monitoring of a forest for the early detection and reporting of forest fires. The system comprises remotely deployed detection units which house infrared sensors, video cameras, weather sensors, a local processor and communications equipment. These remote detection units are linked to a central command station which receives and processes data from the remote sites, visually displays images from the remote sites on monitors for observation by fire fighting personnel, and contains data processing equipment which can process the remotely received data and output, for use by fire fight personnel, a forecast of the projected path of the fire front as the fire spreads through the forest.

Each remote detector contains an infrared sensor which is optimized for detection of heat sources in the 200° to 300° C. range against ambient background temperature of 0° to 40° C. Such a sensor is described in U.S. Pat. No. 5,422,484, the disclosure of which is incorporated herein by reference. In addition to the infrared sensor, there is a video camera for optical monitoring of the forest area under surveillance. Both the camera and the infrared sensor are mounted on a movable platform which allows the camera and infrared sensor to be coincidentally moved over a range of positions covering 360 azimuthal degrees.

Also included in the remote detector are a group of weather sensors which provide information as to local temperature, relative humidity, barometric pressure, wind speed and direction, solar radiation and rain rate. This weather data, in combination with the data from the infrared sensor, is fed to a local data processor which collects and processes the weather data and infrared sensing data either locally or in response to commands from a central command station. Communications equipment located at the remote site handles data exchange between the remote location and the central command center as well as the transmission of video images for visual monitoring at the central command station.

The local processor also has the responsibility of preprocessing the data sent to the central station so as to eliminate the possibility of false alarms. The local processor receives sensor data from the infrared sensor and analyzes it over the entire 360° sensing range, one azimuthal degree at a time. Of course the area viewed may be less than 360°, and the processor can easily take this into account. In order to eliminate the possibility of false alarms as a result of the position of the sun with regard to the sensor, the processor calculates the value of the derivative of the infrared signal, thereby eliminating the effects of long term changing signal effects, on an angle scale of, for example, 10°. Such long term variations are typically due to variations of the angle between the line of sight of the sensor and the position of the sun, and by taking this into account the processor thereby eliminates false alarms resulting from solar radiation. Contrarily, point variations of less than or equal to 1° are left unchanged since these are typical of the signals received when a fire is developing. The processor then extracts the mean square value of the fluctuation of the signal subject to derivation for a group of data, corresponding to a vertical position which is established as a reference line. The calculated value is proportional to the fluctuations of background radiation along the developed reference line and, when multiplied by a suitable pre-established constant value, is taken as a threshold for the detection of potential fire signals. Based upon the detection threshold determined previously, the processor identifies any signal present above such threshold along the calculated detection line for a given azimuth angle and compares it with that of signals detected in previous scans of the same forest area. This comparison is necessary to confer improved reliability to the alarm system by registering an alarm only if there are a number of consecutive confirmed appearances of a signal along the established line. Typical operation parameters call for an alarm signal to be taken as true and therefore transmitted to the central command station only if a fire signal is confirmed in greater than or equal to two of four successive scans of the same forest area. It is expected that the procedures previously outlined may be completed by the remote detection unit in about three minutes, therefore improving present detection times of fire in a wooded area quite considerably.

The remote communication subsystem, typically a radio link, is also controlled by the remote processor and provides for digital transmission of detected alarms, weather data and video images to the central command station.

The central command station receives communications from the remote detectors through a central communication system. Video data from each location is sent to video monitors for selective viewing of video images coming from the remote detection units. Video recording of such images is also provided. Alarm data and weather data is fed to a central processor which is responsible for overall control of the system. The central processor is responsible for remote control of the remote detection units, recording of all data received on a suitable mass storage medium, and processing the data received in accordance with a forecasting program which processes the received data along with previously stored data regarding known forest characteristics. The program integrates currently received weather data and alarms which information contained in an archival data base such as topographical characteristics of the forest, nature and distribution of vegetation in the area, historic weather and humidity data as well as possible human presence in the area. This integrated data is applied to a model which generates a forecast of fire propagation. This forecast is available as hard copy output showing the forecasted fire front, and its predicted path of movement overlaid on a detailed topographic map of the forest.

It is therefore an object of the present invention to provide a system which remotely monitors a forest for the presence of fires and reports fire conditions with high reliability, rapidity and without the need for human presence at the detection site.

It is also an object of the invention to provide a system capable of reducing the possibility of false alarms by confirming fire detection signals at the site of detection.

It a further object of the invention to provide an automatic system which can provide real time video images of the area under surveillance.

It is a still further objection of the invention to provide an automatic system which can collect data as to the presence of fires as well as instantaneous data from the site of fire detection, and to use these data in combination with data regarding known forest characteristics to produce a reliable forecast of the propagation, speed and direction of the fire for the purposes of producing a topographic map of the forest which includes a forecast of the development of the fire for the purpose of optimizing fire fighting techniques.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
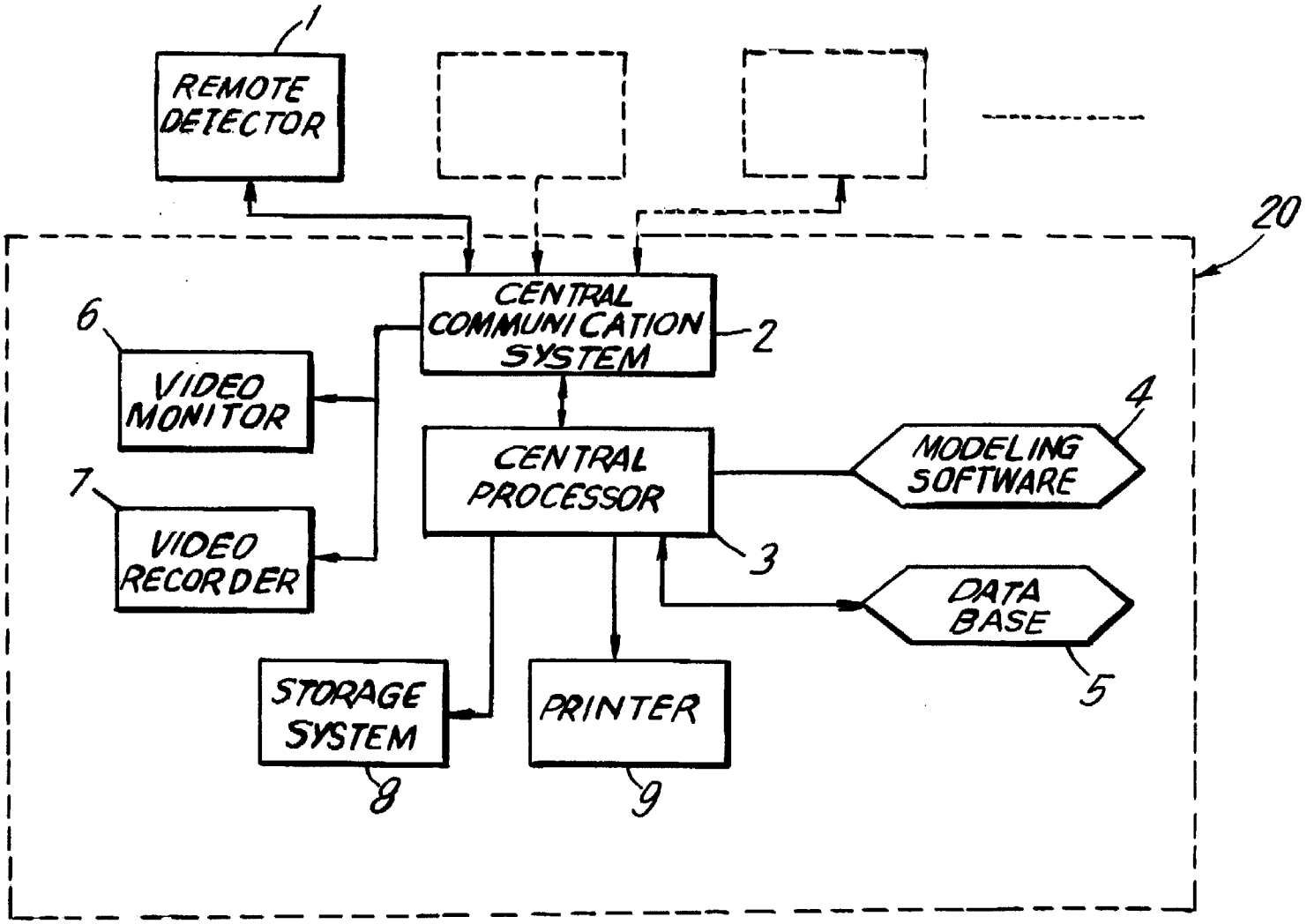
FIG. 1 is a block diagrammatic representation of the fire detection system of the present invention.

With initial reference to FIG. 1, a block diagram of the central command station 20 of the fire detection and reporting system of the present invention is depicted. A series of remote peripheral detectors 1 are connected via a central communication system 2 to a central processor 3 which, as will be further described herein, is responsible for overall system command and control. The communication system 2 receives data from the remote peripheral detectors 1, which includes video images which are selectively displayed on a video monitor 6 and selectively recorded on video recorder 7. The data received is processed by central processor 3 according to centrally stored data base 5 as applied to a modeling software program 4. The central processor possesses suitable mass storage system 8 for storage and retrieval of system data and software, as well as output devices such as printers 9 for hard copy output of data, alarms and software output.

Figure 2:
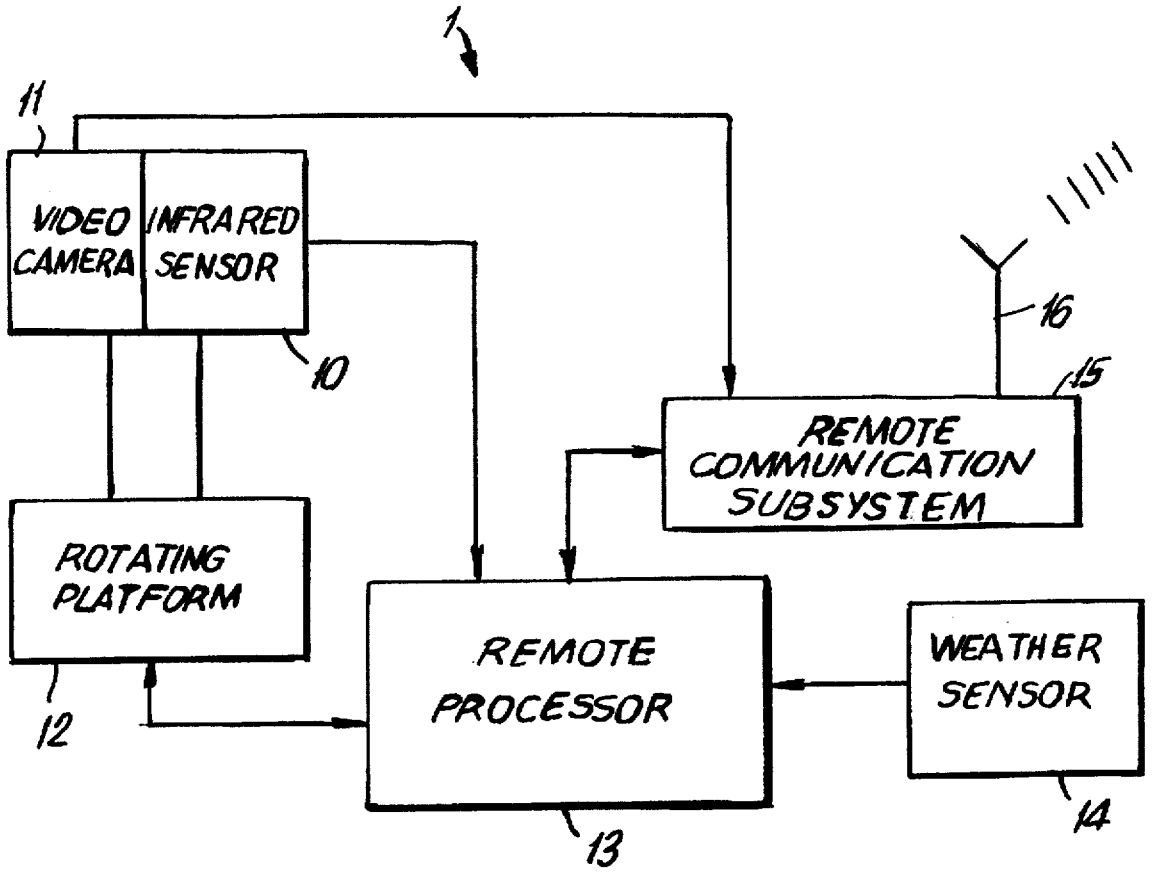
FIG. 2 is a block diagrammatic representation of the remote peripheral detector used in the system.

Referring now to FIG. 2, the components of the remote peripheral detector 1 are shown in detail. The remote detector 1 is positioned in the forest area at predetermined locations, each detector being responsible for surveying a particular area of the forest. Multiple detectors can be connected to central processor 3 via communication system 2, typically in quantities of from five to ten. The remote detector contains three main data collection elements which are individually described below, followed by a description of the interconnection of the elements and then followed by a description of the overall systems' operation.

The first data collection element of the remote detector 1 is a video camera 11 for direct optical surveillance of the detection area. Video camera 11 is mounted on a rotating platform 12 which is typically a motor driven unit which confers an azimuthal scan to the video camera over an area of 360°, or less if necessary. Also mounted on rotating platform 12 is the second data collection element, that being an infrared sensor 10, which is capable of detecting heat sources in the forest area being scanned. The infrared sensor 10 has a spectral sensitivity so as to optimize detection of heat sources in the 200° to 300° C. range against an ambient background temperature of the forest which typically falls within a 0° to 40° C. range. The third data collection element is a weather sensor unit 14 which is capable of sensing local weather conditions such as temperature, relative humidity, barometric pressure, wind speed and direction, solar radiation and rain rate at the detector site.

The elements are functionally connected at each remote site in the following manner:

Data from the weather sensor 14, along with sensor data from infrared sensor 10 is fed to a remote processor 13. Remote processor 13 is responsible for a number of functions, such as controlling—either directly or in response to control signals from central processor 3—the movement of rotating platform 12, collecting weather data from weather sensor 14 for subsequent transmission to central command station 20, and pre-processing the data received from infrared sensor 10 for the purpose of false alarm detection and actual alarm transmission. Remote processor 3 is linked to central processor 3 via remote digital communication subsystem 15 and central communication system 2. Video camera 11 is connected directly to remote communication subsystem 15 for the transmission of direct video images back through central communication system 2 to video monitor 6. The communication between remote communication subsystem 15 and central communication system 2 is achieved via radio link, although other wireless or wired digital data links are equally applicable. An antenna 16 is provided to transmit and receive the radio signals.

Prior to full operation, the system must be set up. The areas to be scanned by each remote detector 1 are determined during system setup with the aid of an intervisibility management program which is a subroutine of the modeling software 4. This program determines the amount of overlap between each area being scanned by remote detectors and guides in the selection of the best locations for the remote detectors to optimize overall fire detection in the forest. The video camera 11 and infrared sensor 10 are capable of being moved by rotating platform 12 over a range of positions covering 360 azimuthal degrees in a substantially horizontal plane. Therefore, the area to be scanned can be controlled so that each remote detector 1 is responsible for an area covering 360 azimuthal degrees or less as required. It is expected that from five to ten remote detectors 1 will be connected to the central command station 20.

Another design factor considered during system setup is the determination of the field of view of the infrared sensor 10. Infrared sensor 10 senses infrared radiation coming from a small angular region, known as a sensor field of view. A typical field of view would be 1° in the horizontal plane and 15° to 20° in the vertical plane. Such a field of view may be flexibly obtained by means of a linear array of individual infrared sensing elements (not shown), so arranged within infrared sensor 10 so as to yield the desired field of view.

Once set up, the system performs forest surveillance generally in accord to the following events hereafter described. In operation, data from infrared sensor 10 is acquired and processed by remote processor 13. The infrared data coming from infrared sensor 10 is fed to remote processor 13 in its entirety. The processor analyzes the infrared sensor data as a series of data points, typically one per azimuthal degree covered. Therefore there are typically 360 data points per scan, or there will be less if the area to be monitored covers less than 360 azimuthal degrees. To reduce the possibility of false alarms and to improve sensitivity of detection, the processor 13 calculates a value of the derivative of the infrared data signal coming from infrared sensor 10. This calculation is used by processor 13 for the elimination of long term signal changing effects over a scan angle of, for example, 10°. Such variations are typically due to the variation of the angle between the line of sight of the sensor and the position of the sun. This improves the reliability of the detector by eliminating the sun as a potential heat source which may trigger false alarms. On the other hand, point variations are left unmodified when less than or equal to 1°, since these are typical of the signals received from a developing fire. In this case, the processor extracts the mean square value of the fluctuations of the signal subject to derivation for a group of data points corresponding to a vertical position referred to as a reference line. This value is proportional to the fluctuations of the background infrared radiation along the reference line itself and, when multiplied by a suitable constant value, becomes a threshold value for the detection of possible fire signals. Based upon this established threshold value, the processor identifies any signal present which is above the threshold along a given reference line. The azimuth angle of the signal is compared with that of signals detected in the previous scans. This results in an alarm signal of greater reliability since the signal is based on a number of consecutive confirmed appearances of the heat source. In operation, an alarm is taken as reliable and therefore transmitted to the central command station 20 only if it has been calculated as confirmed greater than or equal to twice in four successive scans of the same forest area. It is expected that this procedure of confirmation and point source location can be accomplished in approximately three minutes, therefore greatly reducing detection times by a considerable amount.

When a fire condition is determined to be present, remote detector 1 transmits the position of any possible fire, together with weather data and video images from video camera 11, to central command station 20 by means of remote communication subsystem 15, which is received and sorted by central communication system 2. Video images are selectively displayed on monitor 6 and can also be recorded on video recorder 7. The fire and weather data is fed to central processor 3, which, in addition to other functions later described, overlays, via software, the alarm locations on topographic maps stored in an electronic data base 5. A modeling program 4 then develops a forecast of fire evolution which is a prediction of the growth path of the fire over time in the hours following alarm detection, based upon known forest characteristics, historic weather information (developed with weather data acquired by remote detectors 1), current weather information, vegetation and other known forest data also stored in data base 5.

Central processor 3 may be made up of a single processor or a number of attached processors which perform a number of functions. Among the key functions performed by the single processor or multiple processor contained in central processor 3 are:

- control of the remote detectors 1 and receipt and exchange of data signals via the communication link;
- plotting alarm data received from remote detectors 1 on topographic maps of the forest area by means of a three dimensional projection software program which calculates possible intersections between alarms coming from different remote locations so as to assure accurate fire location;
- integration of alarm information and current weather data supplied by the remote detectors 1 with historical weather information contained in the central data base 5;
- utilization of this integrated data by a modeling software program 4 which produces a fire propagation model which charts the projected growth pattern of the fire as it is forecasted to develop over time; and
- selective storage and retrieval of all system data in a suitable mass storage system 3, such as magnetic disks or tape or optical disks.

Overall system status, display and control, including alarm message printing, is also controlled by central processor 3.

The software programs of the system, some of which operate on line and others which may be operated off-line, perform several major functions. The first program used is for the digitizing and storage of known topographic and schematic maps of the forest area which is under surveillance. This digitized data forms the underlying medium by which the alarms received are displayed on the system monitor of the processor, and this digitized data is also used in the development of the forecast algorithms used by the modeling software which predicts the growth path of the fire.

Another software module provides peripheral management, typically performed off-line, and is used for outputting displayed graphics in a hard copy medium. This hard copy forms the documentation utilized by fire fighting personnel in the forest.

Another software module performs intervisibility management which is applied between any point or the digitized map data and the remote detector sites. This function is used mostly during system setup as a guide selecting the best remote detector viewing locations in the forest.

One of the most significant software modules is the previously described modeling software which enables the system to produce, based upon an algorithm, a forecast of the anticipated path of fire development over time. The model, as applied to the digitized topographical map data as well as both current and historic forest data, is based upon an algorithm which incorporates the speed and direction of the wind, on the ground gradient and, the type of fuel available on the forest floor, resulting in a propagation speed of the fire as a function of absolute azimuth angle against north. The algorithm adopted utilizes the following parameters:

Vfo, which is the intrinsic average speed of propagation of the fire (i.e., speed at zero ground slope and zero wind speed).

Vfc, which is the variation of the fire propagation speed depending on the type and moisture content of the burning vegetation. Data on the distribution of vegetation is obtained from the data base 5 which contains the data regarding known forest characteristics.

Wind effects are quantified by the following parameters which effect calculated propagation speed:

Ci, which is an incremental/decrement, angle dependent, in propagation speed due to morphology (i.e., terrain slope). It is independent respective to the angle of wind direction but is dependent on wind intensity.

Ct, which is the transport constant of the fire front edge, which is dependent upon the angle between the propagation line and wind direction.

The forecasting program provides a graphic output overlaid on a topographic map showing forecasted successive positions of the fire front at pre-established time intervals. This output is used by fire fighting personnel in deploying firefighting resources.

Figure 3:
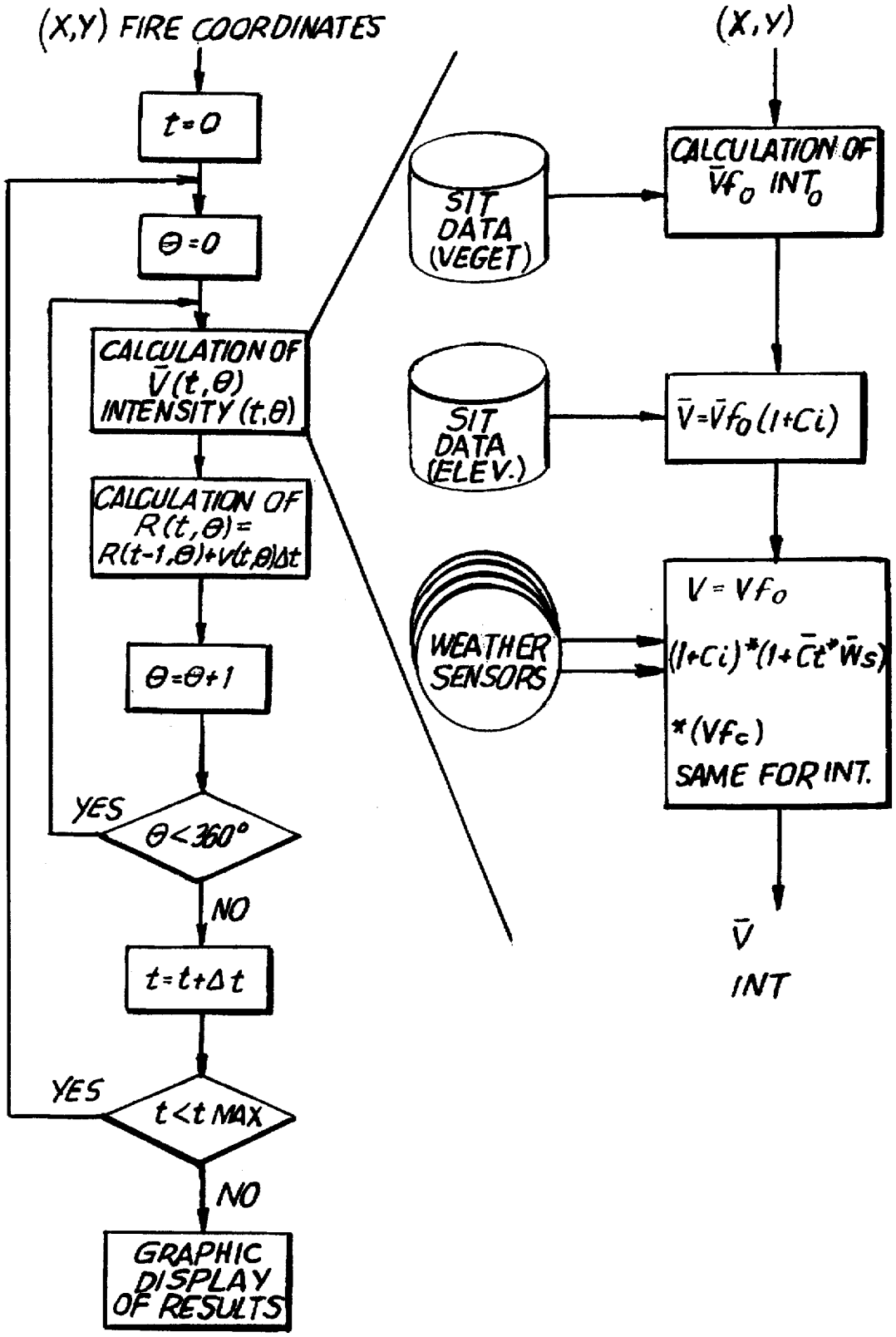
FIG. 3 is a flow diagram of the propagation speed and direction algorithm.

The propagation speed and direction algorithm is illustrated in the flow diagram in FIG. 3. The propagation speed for a given direction of propagation θ, referred to north, at a point with slope magnitude Ss and angle αS and subject to a wind with speed Ws and direction αw is given by:

$$V(\theta)=Vfo*(1+Ci*F1(Ss)*F2(\theta-\alpha s)+Ct*F3(Ws)*F4(\theta-\alpha w))$$

This speed is then multiplied by the factor Vfc times a function of the estimated water content of the fuel to give the actual propagation speed in the direction θ.

$$V(\theta)=V(\theta)*Vfc*F5(\text{Water_Content})$$

Integration over time will give the required growth contour at fixed intervals to be displayed, superimposed onto a digital map of the territory, to an operator.

The four constants Vfo, Vfc, Ci and Ct may be easily read in the system geographic database for each point and can be adjusted to give consistent results with any vegetation type.

The main advantages of this model are:

effective calculation of whether data in real time;

propagation obstacles (roads, etc.) can be added simply by setting Vfo=O;

any spatial variation in vegetation type or wind speed can be accommodated;

the model may be adjusted to also cover various other types of soil use categories;

seasonal variations of vegetation need only a re-appraisal of data base values.

Therefore it can be seen that the integration of video, infrared radiation and weather data from a multiplicity of sites throughout the forest, when acted upon by customized modeling software, can provide highly accurate information on the actual location of the fire detected, as well as a highly accurate forecast of the projected path of the fire, thereby allowing fire fighting personnel to optimally deploy fire fighting equipment so as to rapidly extinguish the fire. The system is capable of storing historic weather and alarm information in a central data base so that the system makes use of the most current and accurate data regarding forest characteristics, thereby improving overall system accuracy and dependability.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

We claim:

1. A forest surveillance and monitoring system for detecting and reporting forest fires in a forest having an ambient infrared background temperature, said system comprising:

a peripheral detection station including:

means for collecting current weather data;

infrared sensor means for detecting a given surveyed area, said infrared sensor means being operative to measure radiation flow along scan lines from a small angular region of said area and to output corresponding signals;

rotating means for supporting the infrared sensor means and imparting an azimuth scan to the infrared sensor means;

local processor means connected so as to receive the signals from the infrared sensor means and data from the weather data collecting means; and a peripheral station communications subsystem connected to the local processor means for transmitting data therefrom; and a local control center which includes:

a historical data bank containing information on vegetation distribution and recent weather conditions in the surveyed area;

a communication subsystem which receives data from the peripheral station communication subsystem and emits commands for controlling the local processor, the local processor being configured to manage a data exchange with the local control center;

peripheral memory means for recording data; and central processor means for controlling the peripheral detection station, controlling an exchange of commands and data, illustrating a notified alarm on topography maps of the area, recording data on the peripheral memory means, displaying system status and integrating the notified alarm with data of the historical data bank, the local processor means being operative to provide for extraction of a fire alarm and to cause transmission of an alarm signal and the weather data to the local control center via the peripheral station communication subsystem and the communication subsystem, the central processor means of the local control center being operative to integrate the alarm extracted by the peripheral detection station with instantaneous weather data and with data from the historical databank so as to develop a fire propagation model as a function of said integration whereby the model is based upon the instantaneous weather data, the vegetation distribution, and the recent weather conditions which results in a propagation speed and direction of a detected fire.

2. A system as defined in claim 1, wherein the means for collecting current weather data includes a plurality of weather sensors for obtaining temperature, relative humidity, pressure, wind speed and direction, solar radiation and rain rate data.

3. A system as defined in claim 1, wherein the historical data bank contains information on ground gradients and on human presence in the surveyed area, which information is used by the central processor means for calculation of the fire propagation model and for a display of an area to be protected.

4. A system as defined in claim 1, wherein the peripheral detection station further includes a video camera arranged to visually monitor the surveyed area, the video camera being mounted on the rotating means, the local control center further including a video monitor operative to display video images from the video camera of the peripheral detection station, said communication subsystems being operative to transfer signals from the video camera to the video monitor, the local control center further including a video recorder for recording the video images.

5. A system as defined in claim 1, wherein the local control center further includes a printer operatively provided to print alarm messages generated by the central processor means.

6. A system as defined in claim 1, wherein the infrared sensor means is configured to have spectral sensitivity so as to provide an optimum detection of hot sources within 200°–300° C. against an ambient temperature background within 0°–40° C.

7. A system as defined in claim 1, wherein the rotating means includes a rotating platform operatively connected to the local processor means of the peripheral detection station so as to confer an azimuth scan to the infrared sensor means over 360 degrees.

8. A system as defined in claim 1, wherein the local processor means is operative to calculate a value of a derivative of the signals output by the infrared sensor means, to extract a mean square value of fluctuations of the signals subject to derivation for each group of data corresponding to a vertical position, and to multiply the mean square value with a constant value and supply a threshold value for detection of a possible alarm system.

9. A system as defined in claim 1, wherein a plurality of peripheral detection stations are provided, the local control center being operative to control the plurality of peripheral detection stations.

10. A system as defined in claim 9, the central processor means is operative to receive alarms from different of the peripheral detection stations, and to calculate possible intersections between said alarms.

* * * * *

UNITED STATES PATENT AND TRADEMARK OFFICE

CERTIFICATE OF CORRECTION

PATENT NO. : 5,734,335

DATED : March 31, 1998

INVENTOR(S) : Giulio BROGI, Luca PIETRANERA, Francesco FRAU

It is certified that error appears in the above-identified patent and that said Letters Patent is hereby corrected as shown below:

ON THE TITLE PAGE

Change "Assignees: Finmeccanica S.p.A.; Ramo Aziendale Alenia, both of Rome, Italy" to --Assignee: Finmeccanica S.p.A. - Ramo Aziendale Alenia, of Rome, Italy--

Signed and Sealed this

Twenty-eighth Day of December, 1999

*Attest:*

Q. TODD DICKINSON

*Attesting Officer*

*Acting Commissioner of Patents and Trademarks*